US011624316B2

(12) United States Patent
Probus et al.

(10) Patent No.: US 11,624,316 B2
(45) Date of Patent: Apr. 11, 2023

(54) VACUUM-SOURCE ADAPTER FOR ADMINISTERING A CLEANING FLUID

(71) Applicant: BG Intellectuals, Inc., Wichita, KS (US)

(72) Inventors: Thomas Michael Probus, Wichita, KS (US); Bradley Robert Young, Wichita, KS (US); John Daniel Cheek, Wichita, KS (US); Lucas Mitchell Shaw, Wichita, KS (US); Michael Jason Erwin, Augusta, KS (US)

(73) Assignee: BG Intellectuals, Inc., Wichita, KS (US)

( * ) Notice: Subject to any disclaimer, the term of this patent is extended or adjusted under 35 U.S.C. 154(b) by 0 days.

(21) Appl. No.: 17/512,404

(22) Filed: Oct. 27, 2021

(65) Prior Publication Data

US 2022/0128000 A1 Apr. 28, 2022

Related U.S. Application Data

(60) Provisional application No. 63/106,071, filed on Oct. 27, 2020.

(51) Int. Cl.
*F02B 77/04* (2006.01)

(52) U.S. Cl.
CPC ..... *F02B 77/04* (2013.01); *F02B 2077/045* (2013.01)

(58) Field of Classification Search
CPC ..... F02B 77/04; F02B 2077/045
USPC ..... 123/1 A, 198 A, 198 D, 198 E, 668–670; 134/22.19, 22.14, 22.11
See application file for complete search history.

(56) References Cited

U.S. PATENT DOCUMENTS 4,628,871 A * 12/1986 Glass ..... F02M 25/0225 123/25 J
4,694,804 A * 9/1987 DeGrazia, Jr. ..... F02M 69/24 123/462
4,989,561 A * 2/1991 Hein ..... F02B 77/04 134/30
6,298,947 B1 * 10/2001 Flynn ..... F16N 33/00 141/85
2004/0020720 A1 * 2/2004 Flynn ..... F01M 11/04 134/104.4
2022/0186687 A1 * 6/2022 Tamas ..... F02M 17/36

* cited by examiner

*Primary Examiner* — Hai H Huynh
(74) *Attorney, Agent, or Firm* — Shook, Hardy & Bacon LLP

(57) ABSTRACT

The present disclosure relates to an adapter that is attachable to an engine vacuum source (e.g., insertable into an end of a vehicle-engine vacuum hose) to receive a cleaning fluid from a canister (e.g., aerosol can) and to meter the cleaning fluid into the vacuum source. The adapter may include a vacuum-source insert and a nozzle receiver. In addition, the adapter may include a fluid path between the vacuum-source insert and the nozzle receiver that meters a flow of cleaning fluid.

17 Claims, 5 Drawing Sheets

VACUUM-SOURCE ADAPTER FOR ADMINISTERING A CLEANING FLUID

CROSS-REFERENCE TO RELATED APPLICATIONS

This Non-Provisional patent application claims the benefit of U.S. Provisional Application No. 63/106,071, filed Oct. 27, 2020, and entitled "Vacuum-Source Adapter For Administering A Cleaning Fluid," the entire contents of which is incorporated herein by reference.

TECHNICAL FIELD

Subject matter described herein is directed to an adapter that is attachable to a vacuum source of an engine and that is usable to administer a cleaning fluid to the engine.

BACKGROUND

Motor vehicle engines (e.g., gasoline engines) have various components that participate in the combustion process—e.g., an air intake duct, a combustion chamber (or chambers), and an exhaust duct. Sometimes, an engine may accumulate or build up material deposits (e.g., carbon, oil, etc.) on various components (e.g., intake and exhaust valves) during phases of operation (e.g., during the combustion process and the cool off period after the engine is shut down). Deposit build-up may affect engine performance in various respects, such as by reducing efficiency or by restricting the relative motion of engine components (e.g., not properly sealing).

Conventional solutions for removing build-up include spraying a cleaner into the mouth of the air intake of the engine while the engine is running. However, the cleaner often does not reach the valve(s) as the highly atomized cleaner may fall out of the suspension before arrival due to the distance between the mouth of the intake assembly and the valve(s). Other solutions include removing major engine components, such as the intake manifold or air intake tube, to access the intake valves themselves to then directly clean the valves, but this is time consuming and tedious and prone to complications (e.g., during servicing and when the components are reassembled). For example, removing the air intake tube may also require removal of sensors (e.g., mass airflow sensor, manifold pressure sensor, etc.) to enable the vehicle to run with the air intake tube removed. Since engine specifications often vary between vehicles types, different procedures may be required from one vehicle to the next, which requires formulating and updating engine-specific or vehicle-specific instructions, which can be time consuming and prone to error (e.g., human error).

Another conventional solution includes administering a cleaning agent to a port of the vacuum system by a gravity-fed aerosolizing delivery system. However, in this case the system includes specialized parts, such as a gravity-fed dispenser, that are often not as available to some technicians or vehicle servicers, who may have access to only aerosolized cans of cleaning agent.

SUMMARY

The present disclosure relates generally to a vacuum-source adapter to administer cleaner (e.g., aerosolized cleaning fluid). More specifically, the adapter is attachable to a vacuum source of an engine (e.g., insertable into an end of a vehicle-engine vacuum hose) to receive a cleaning fluid from a canister (e.g., aerosol can) and to meter the cleaning fluid into the vacuum source. Since the vacuum-source adapter can be selectively inserted into one of many of the engine vacuum sources (e.g., all of the engine vacuum hoses), the adapter enables administration without significant removal of engine components. In addition, the adapter provides a simplified engine-cleaning procedure that may be performed with limited equipment and supplies (e.g., with only the adapter and an aerosol canister of cleaning fluid).

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

Articles and methods related to a vacuum-source adapter to administer cleaning fluid are described in detail in the Detailed Description with reference to the figures briefly described directly below, which are incorporated herein by reference. These figures are submitted together with this disclosure.

DETAILED DESCRIPTION

Subject matter is described throughout this Specification in detail and with specificity in order to meet statutory requirements. But the aspects described throughout this Specification are intended to be illustrative rather than restrictive, and the description itself is not intended necessarily to limit the scope of the claims. Rather, the claimed subject matter might be practiced in other ways to include different elements or combinations of elements that are similar to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

At a high level, this disclosure describes devices and methods related to cleaning engine components of a motor vehicle (e.g., by removing build-up of carbon or other materials). More specifically, this disclosure describes an adapter that is attachable to a vacuum source of a vehicle engine (e.g., insertable into an end of a vehicle-engine vacuum hose, into a sensor port, etc.) to receive a cleaning agent (e.g., aerosolized or foamed cleaning fluid) from a canister and to meter the cleaning agent into the vacuum source. Since the vacuum-source adapter can be selectively inserted into one of many vacuum sources (e.g., potentially all of the engine vacuum hoses, sensor ports, etc.), the adapter enables administration without significant removal of engine components. In addition, the subject matter of this disclosure provides a simplified cleaning solution that can be performed using limited supplies and equipment, such as only the adapter and a canister of cleaning fluid (e.g., aerosol canister of cleaning fluid).

Figure 1:
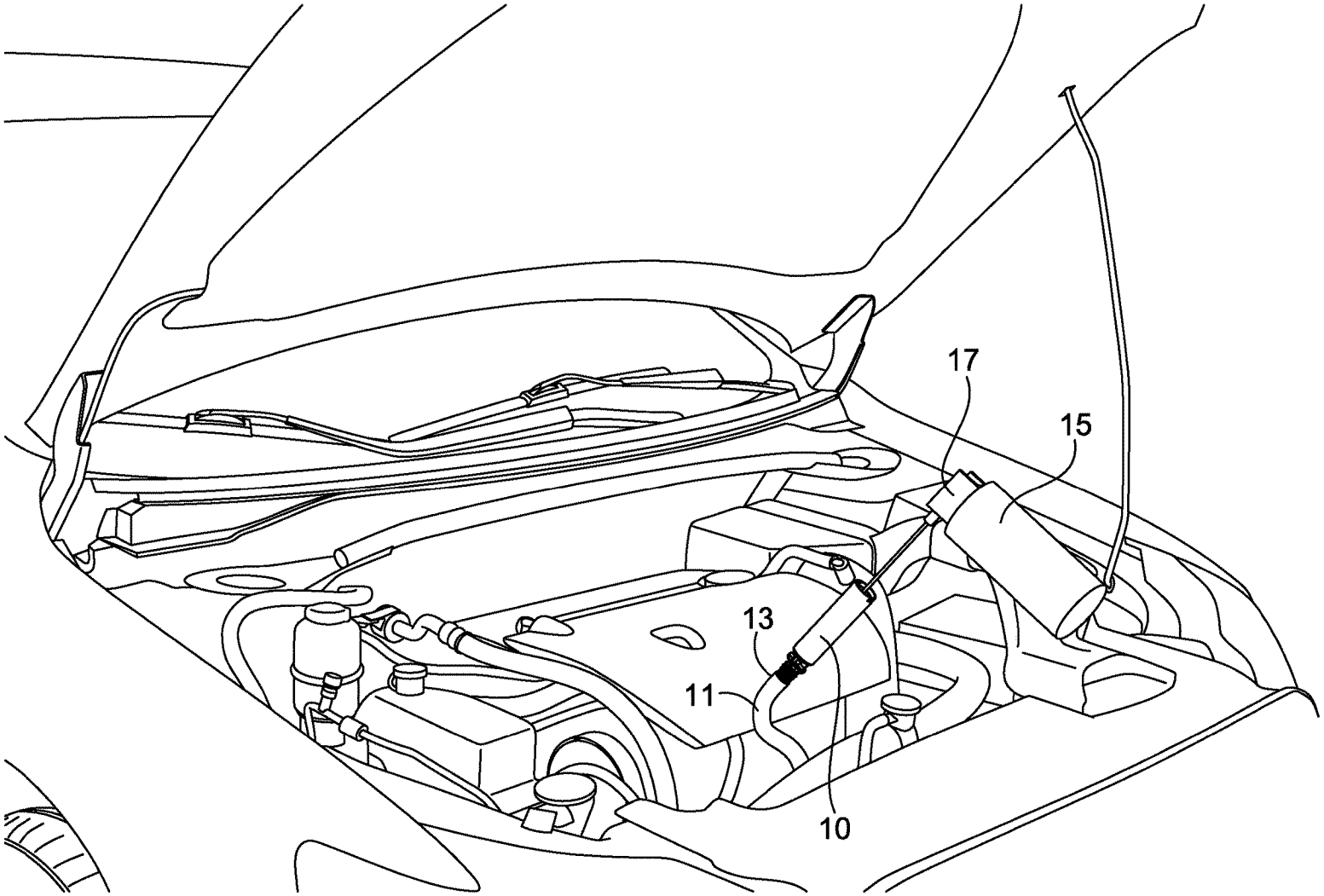
FIG. 1 is an illustration of an example environment in which an adapter might be used to administer cleaning fluid through a vacuum hose.

Referring to FIG. 1, FIG. 1 illustrates an example environment (e.g., under a hood of a vehicle) in which a vacuum-source adapter 10 may be used to administer a cleaning fluid. In addition to the adapter 10, FIG. 1 depicts a vacuum hose 11 having a free end 13 that has been detached from an engine component. FIG. 1 also depicts an aerosol canister 15 of cleaning fluid. In an aspect of the present disclosure, the adapter 10 is insertable into the free end 13 of the vacuum hose 11, and the adapter 10 receives part of the nozzle 17 of the canister 15. Using the nozzle 17, cleaning fluid may be flowed into the adapter 10, and as will be described in more detail in other portions of this disclosure, the adapter 10 may facilitate transmission of the cleaning fluid into the vacuum hose 11. As illustrated in FIG. 1, a vacuum hose is one example of a vacuum source. As used herein, a vacuum source may comprise any engine component through which a negative pressure arising from the vehicle engine is pulled. Another example of a vacuum source is a sensor port, such as a port on an air intake that can receive the adapter after a sensor is removed. Yet a further example of a vacuum source is a barb positioned on the air intake, such that the adapter may be inserted onto the barb. In accordance with an aspect of the disclosure, the adapter 10 is attachable to a variety of different engine vacuum sources, including a vacuum hose, a sensor port (e.g., on an air intake), a barb (e.g., on an air intake), etc.

Figure 2:
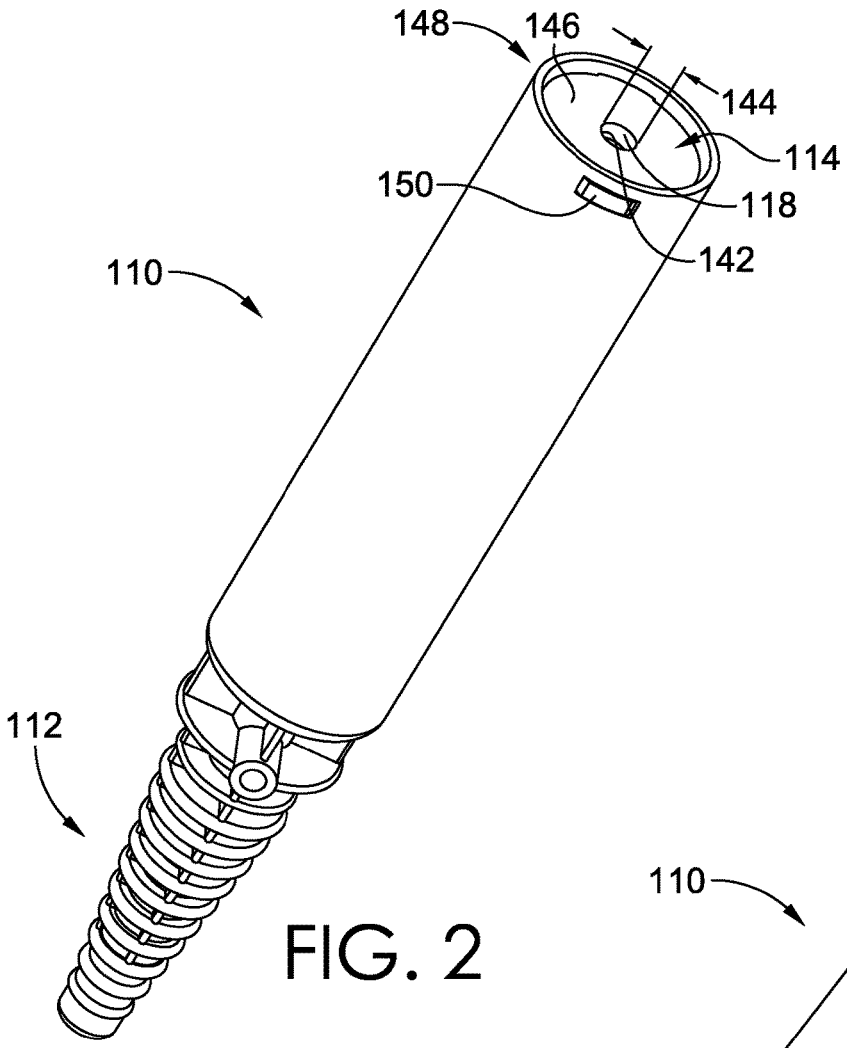
FIG. 2 is an illustration of an example vacuum-source adapter to administer cleaning fluid to an engine, in accordance with an embodiment of the present invention.
Figure 3:
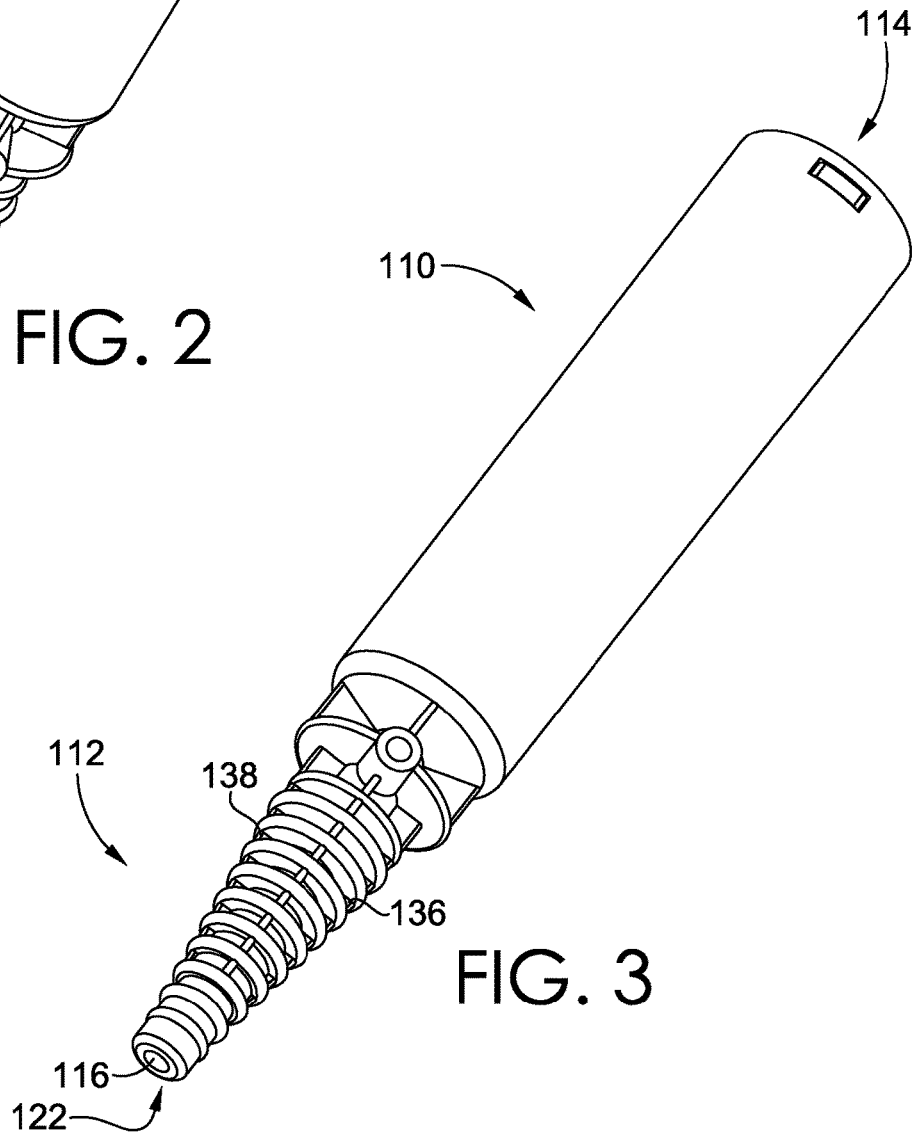
FIG. 3 illustrates the vacuum-source adapter of FIG. 2 from a different perspective, in accordance with an embodiment of the present invention.

Referring now to FIGS. 2 and 3, each of FIGS. 2 and 3 illustrates a perspective view of an adapter 110 in accordance with an embodiment of the present disclosure. At a high level, the adapter 110 includes a vacuum-source insert 112, which is attachable to a vacuum source (e.g., insertable into an end of a hose, such as a vacuum hose attached to a vehicle engine). In addition, the adapter 110 includes a nozzle receiver 114 to couple to a nozzle of a canister, such as a canister (e.g., aerosol can) containing a cleaning fluid. The vacuum-source insert 112 includes a first opening 116, which is viewable in the perspective shown in FIG. 3, and the nozzle receiver 114 includes a second opening 118, which is viewable in the perspective shown in FIG. 2. The first opening 116 and the second opening 118 are fluidly coupled (e.g., directly or indirectly via a fluid path passing through the body of the adapter 110), such that a cleaning fluid administered through the second opening 118 may pass through (e.g., exit from) the first opening 116. For example, when the vacuum-source insert 112 is secured to a vacuum source (e.g., in a vacuum hose) and cleaning fluid is sprayed into second opening 118, the vehicle engine may pull a negative pressure through the vacuum source, and in turn, through the adapter 110. The negative pressure pulled on the adapter 110 may draw the cleaning fluid, which is administered through the second opening 118, through the first opening 116.

Figure 4:
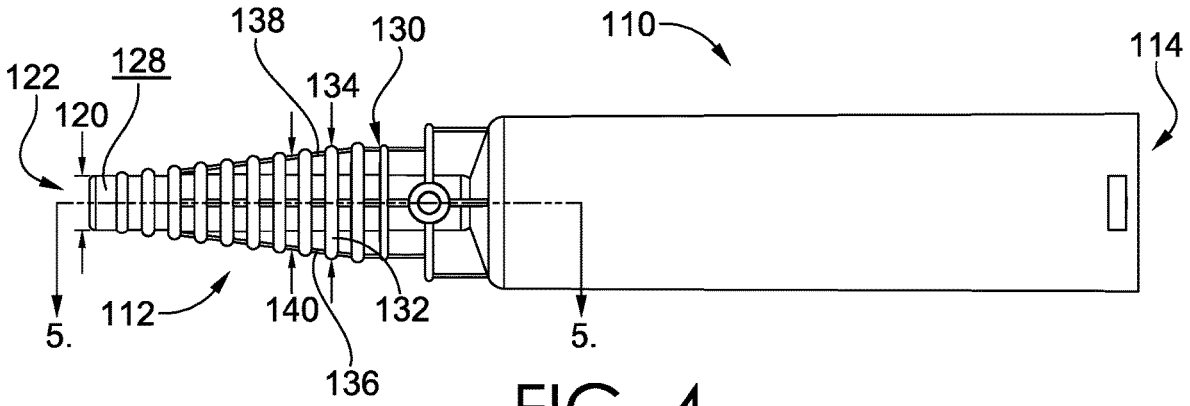
FIG. 4 illustrates a side view of the vacuum-source adapter of FIGS. 2 and 3, in accordance with an embodiment of the present invention.

In a further aspect, the vacuum-source insert 112 includes various structures that operate to releasably engage with, or be releasably received within, a vacuum source (e.g., within a vacuum hose or a sensor port of a vehicle engine). For example, referring now to FIGS. 3, 4, and 5, in one aspect of the present disclosure, the vacuum-source insert 112 includes a width 120 near a first terminal end 122 of the adapter 110, and the width 120 may be configured to slidably fit into an open end of a vacuum source. The width 120 may be embodied or manifested in various types of structures. For instance, the vacuum-source insert 112 may include a tip near the first terminal end 122, and the tip may include a wall 124 that circumscribes the first opening 116. The wall includes an inner surface 126 facing towards the first opening 116 and outer surface 128 that faces away from the first opening 116 and that includes opposing points (on opposite sides) spaced apart by the width 120. In an aspect of the disclosure, the width 120 may include a width that is about equal to or less than an inner diameter of a vacuum hose.

The vacuum-source insert 112 may include other elements as well. For example, the vacuum-source insert 112 may be configured to frictionally engage an inner surface of a vacuum source (e.g., inner surface of a hose). The width 120 may be such that a vacuum hose elastically stretches onto the vacuum-source insert 112 when the vacuum-source insert 112 is manipulated into the open end of the hose. In other aspects, the vacuum-source insert 112 and/or the outer surface may include one or more barbs or ribs. In yet a further embodiment, the vacuum-source insert 112 may additionally, or alternatively, include a portion that tapers. For example, the vacuum-source insert 112 includes a vacuum-source-insert base 130 that couples the vacuum-source insert 112 to other portions of the adapter 110. In addition, the vacuum-source insert 112 includes one or more portions that are between the first terminal end 122 having the width 120 and the vacuum-source-insert base 130 and that are wider than the width 120. In one aspect, the vacuum-source insert 112 includes one or more annular bodies (e.g., annular body 132) that extend annularly around the vacuum-source insert 112 (e.g., around the wall 124) and that include opposing points having a width or spaced a distance apart (e.g., width 134) that is larger than the width 120. Examples of annular bodies include an annular rib, a ring, a barb, and the like. In an aspect of the disclosure, the annular bodies contribute to a friction fit between the adapter 110 and the vacuum source.

In another aspect, the wall 124 may include one or more flared portions that are wider relative to the width 120 and that are positioned between the terminal end 122 and the vacuum-source-insert base 130. For example, the outer surface 128 may flare or be conical, such that one or more portions between the terminal end 122 and the insert base 130 are wider than the width 120. In another example, the vacuum-source insert 112 may include one or more longitudinal reinforcement ribs 136 and 138 that extend longitudinally along the length of the vacuum-source insert 112 between the vacuum-source-insert base 130 and the terminal end 122, and the longitudinal reinforcement ribs 136 and 138 may include opposing points having a width 140 (or opposing points spaced a distance apart) that is larger than the width 120. In one aspect, a tapered shape of the vacuum-source insert 112 may operate to fit a variety of different sized vacuum sources (e.g., hose or port inner diameters), which allows the adapter 110 to be used with a variety of differently sized vacuum sources.

The nozzle receiver 114 may include various structure that operate to releasably connect the adapter 110 to a nozzle of a canister (e.g., aerosol canister of cleaning agent). For example, the second opening 118 includes a perimeter edge 142 that circumscribes the second opening 118 and that includes opposing points on opposite sides of the second opening 118. In an aspect of the present disclosure, the opposing points are spaced apart by a width 144 (e.g., FIG. 2 and FIG. 7) configured to receive a portion of a canister nozzle, such that at least a portion of the perimeter edge 142 engages the portion of the canister. For example, the perimeter edge 142 may frictionally engage and receive a distribution member (e.g., extension tube or straw) connected to a canister nozzle, such that at least a portion of the distribution member seals against the perimeter edge. Accordingly, the at least partial seal between the perimeter edge 142 and the distribution member helps to reduce the likelihood that a liquid cleaning agent, once distributed through the second opening 118 and into the adapter 110, will inadvertently flow back out of (e.g., exit) the second opening 118. In FIG. 2, the second opening 118 has a circular cross section, and in other aspects, the second opening may have alternative cross-section shapes. For example, the second opening 118 may be an n-sided polygon (e.g., triangle, square, rectangular, etc.); x-shaped; star-shaped; etc.

In a further embodiment, the nozzle receiver 114 includes a cap 146 (e.g., lid, cover, etc.) positioned at a second terminal end 148 of the adapter 110, and the cap 146 includes the second opening 118. The cap 146 may be integrally formed together with other portions of the adapter 110 (e.g., the cap 146 may be co-molded and continuous with other portions of the adapter 110), or alternatively, the cap 146 may be detachable. For example, the cap 146 includes tabs 150 that engage slots or recesses in a portion of the adapter 110 near the second terminal end 148.

As mentioned in other portions of this disclosure, the second opening 118 and the first opening 116 are either directly or indirectly fluidly coupled by a fluid path in the adapter 110, such that when cleaning fluid is distributed through the second opening 118, the cleaning fluid may flow from (e.g., exit) the first opening 116 (e.g., into a vacuum hose). The adapter 110 may include various elements arranged along the fluid path between the first and second openings 116 and 118. For example, referring now to FIGS. 5, 6, and 7, in one aspect of the present disclosure, the adapter 110 includes a fluid-collection chamber 152 to temporarily contain cleaning fluid once distributed into the adapter 110, and the fluid-collection chamber 152 is in fluid communication with the second opening 118. In addition, the adapter 110 includes flow-metering circuitry 154, 156, 158, 160, and 162 to control a flow rate of cleaning fluid when flowing from the fluid-collection chamber 152 to the first opening 116.

The fluid-collection chamber 152 may include various elements. For example, the adapter 110 may include an adapter body 163 having a wall with an inner surface 164. The fluid-collection chamber 153 may be a hollow interior space (not necessarily empty) at least partially enclosed by the wall of the adapter body 163, and the inner surface 164 may face towards the fluid-collection chamber 152. The inner surface 164 may have opposing points on opposite sides of the fluid-collection chamber 152, and the opposing points may be spaced apart by a distance 166 constituting a width of the fluid-collection chamber 152. In an aspect of the present invention, the width 166 of the fluid-collection chamber is larger than the width 144 of the second opening 118. In this manner, the fluid-collection chamber 152 operates as a vessel into which cleaning fluid from a canister may be administered through the second opening 118. The fluid-collection chamber 152 may be generally tubular, and the figures illustratively depict a round tubular shape. In other aspects, the tubular configuration of the fluid-collection chamber 152 may include other shapes, including triangular tube, square tube, rectangular tube, etc. In addition, although the fluid-collection chamber 152 is depicted as a relatively straight or rigid body, in other aspects, the fluid-collection chamber 152 may be flexible or bendable, such as a flexible hose or flexible tube.

In a further aspect of the present disclosure, the adapter 110 includes a flow dampener 168 positioned between the second opening 118 and the flow-metering circuitry (e.g., before a first circuit 154 of the flow-metering circuitry), and the flow dampener 168 may be housed in the fluid-collection chamber 152. Among other things, the flow dampener 168 slows a flow of cleaning fluid administered into the fluid-collection chamber 152 before the fluid flows into (e.g., is drawn into) the flow-metering circuitry (e.g., into the first circuit 154). For example, the flow dampener 168 may include one or more surfaces 170 that obstruct a direct, straight path from the second opening 118 into the first circuit 154 of the flow-metering circuitry. In an aspect of the disclosure, the cleaning fluid may at least temporarily collect on the one or more surfaces 170 of the flow dampener 168 when sprayed into the fluid-collection chamber 152 and prior to being drawn into the first circuit 154 (e.g., drawn by the negative pressure applied from the vehicle engine through the vacuum source). The one or more surfaces 170 may comprise a surface of various types of structures or filters. For example, the flow dampener 168 may include a bristled flow dampener (e.g., pipe or tube-cleaning style) having a plurality of bristles arranged in array. Various alternative flow dampeners may also be arranged in the fluid-collection chamber 152 having alternative structures, such as a mesh substrate, a sponge, a filter paper, a fibrous wool, and the like.

Figure 5:
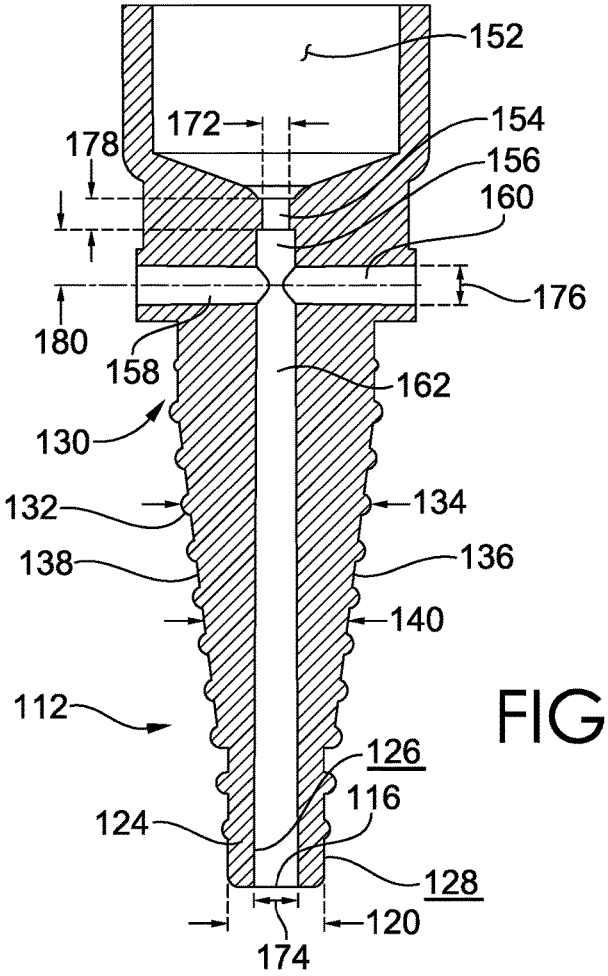
FIG. 5 illustrates a cross-sectional view of a portion of the vacuum-source adapter in FIG. 4, in accordance with an embodiment of the present invention.
Figure 6:
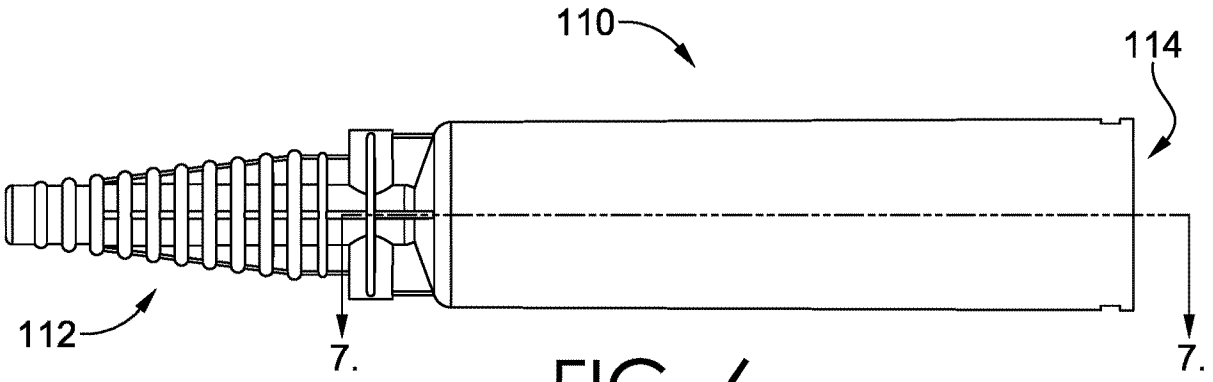
FIG. 6 illustrates another side view of the vacuum-source adapter, in accordance with an embodiment of the present invention, in accordance with an embodiment of the present invention.
Figure 7:
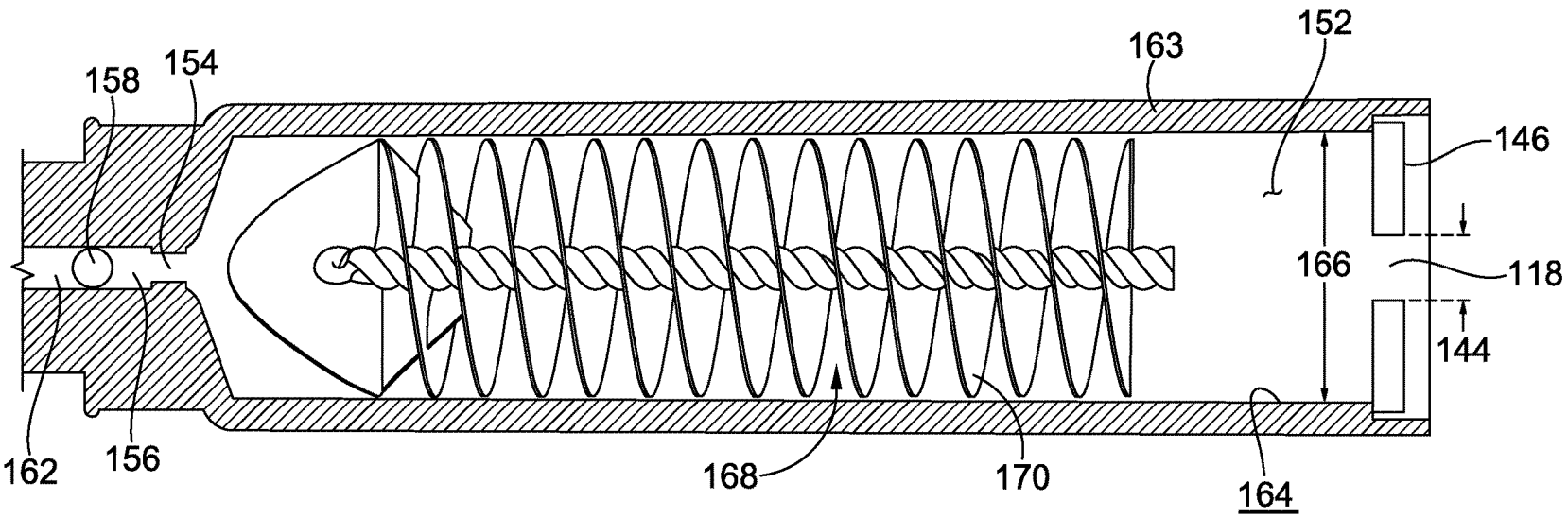
FIG. 7 illustrates a cross-sectional view of a portion of the vacuum-source adapter depicted in FIG. 5, in accordance with an embodiment of the present invention.

Referring to FIGS. 5 and 7, the flow-metering circuitry includes a combination of fluid circuits through which fluid is flowable when administering a cleaning fluid from the fluid-collection chamber 152, through the first opening 116, and into a vacuum source. For example, the flow-metering circuitry includes a cleaning-fluid circuit 154, 156, and 162 providing a fluid path directly from the fluid-collection chamber 152 to the first opening 116. In addition, the cleaning-fluid circuitry includes one or more airflow circuits 158 and 160 through which ambient air may be drawn (e.g., when the adapter 110 is connected to a vacuum source and the engine pulls a negative pressure on then adapter 110). In an aspect of the present disclosure, in practice or in use, the intersection of the airflow circuits 158 and 160 with the cleaning-fluid circuit 154, 156, and 162 operates to aerosolize, re-aerosolize, or further aerosolize cleaning fluid drawn from the fluid-collection chamber 152. For example, ambient air may be drawn into the circuits 158 and 160, and the turbulent, negatively pressured air may mix with or aerosolize cleaning fluid flowing through the cleaning-fluid circuit 154, 156, and 162.

In a further aspect of the disclosure, attributes of the flow-metering circuitry operate to meter cleaning fluid in a manner that allows an appropriate amount of cleaning fluid to be drawn into the vacuum source without flooding the engine. That is, dimensions of the flow-metering circuitry may be calibrated to achieve a target flow rate. For example, the cleaning-fluid circuit includes a first circuit 154 that exits the fluid-collection chamber 152, and the first circuit 154 includes a width 172 (e.g., inner diameter). In addition, the cleaning-fluid circuit includes a second circuit 156 and third circuit 162 that directly, fluidly connects to the first circuit 154 and intersects with the one or more airflow circuits 158 and 160. In an aspect of the present disclosure, the second circuit 156 and the third circuit 162 includes a width 174 (e.g., inner diameter) that is larger than the width 172, such that the first circuit 154 comprises a flow restrictor of the circuit to at least partially regulate the flow of cleaning fluid from the fluid-collection chamber 152 to the first opening 114. For example, in one aspect a ratio of the width 172 to the width 174 is in a range from about 0.070:0.115 to about 0.080:0.105. In a further aspect, the ratio of the width 172 to the width 174 is about 0.074:0.107.

In another aspect of the disclosure, attributes of the airflow circuit also contributes to the metering and aerosolizing. For example, the airflow circuits 158 and 160, which intersect the second circuit 156 and the third circuit 162, both include a width 176 (e.g., inner diameter). In an aspect of the present disclosure, the width 176 is smaller than the width 174 and larger than the width 172. For example, the flow-metering circuitry may include a ratio of the width 176 to the width 174 in a range from about 0.095:0.115 to about 0.104:0.105, and in one aspect, the ratio of the width 176 to the width 174 is about 0.100:0.107. Among other things, these ratios may increase the likelihood that the amounts of both cleaning fluid and ambient air drawn into the flow-metering circuitry will distribute sufficiently aerosolized cleaning fluid in appropriate quantities into the vacuum source. Absent these ratios, the engine-cleaning process may be less effective, since the cleaning fluid may be insufficiently aerosolized or inappropriate amounts of cleaning fluid may be drawn into the vacuum source.

In further aspects of the present disclosure, the circuits may include lengths that also contribute to metering. For example, in one aspect of the present disclosure, the first circuit 154 includes a length 178 extending from a first end or mouth, which interfaces with (fluidly connects with) the fluid-collection chamber 152, to a second end, which interfaces with the second circuit 156. In addition, the second circuit 156 includes a length 180 extending from a first end, which interfaces with the first circuit 154, to a transition to the third circuit 162 (e.g., the transition may be near an axis of the airflow circuits 158 and 160 and/or a mid-point of the intersection). In an aspect of the present disclosure, the flow-metering circuitry includes a ratio of the length 178 to the length 180 in a range from about 0.080:0.155 to about 0.090:0.145. In a further aspect, the ratio of the length 178 to the length 180 is about 0.085:0.150.

The adapter 110 may be constructed of various materials. For example, in one aspect, the adapter 110 may be constructed of an at least partially transparent polymer, such that the cleaning fluid is viewable when sprayed into the fluid-collection chamber 152. As such, a technician may view a state of the cleaning fluid in the fluid-collection chamber 152 while servicing the vehicle. For example, a technician may determine how much cleaning fluid is still in the fluid-collection chamber and observe when the cleaning fluid has been drawn from the fluid-collection chamber 152. Among other things, this may allow the technician to determine when to depress the nozzle of the canister in a subsequent interval to administer additional cleaning fluid into the fluid-collection chamber 152.

Figure 8:
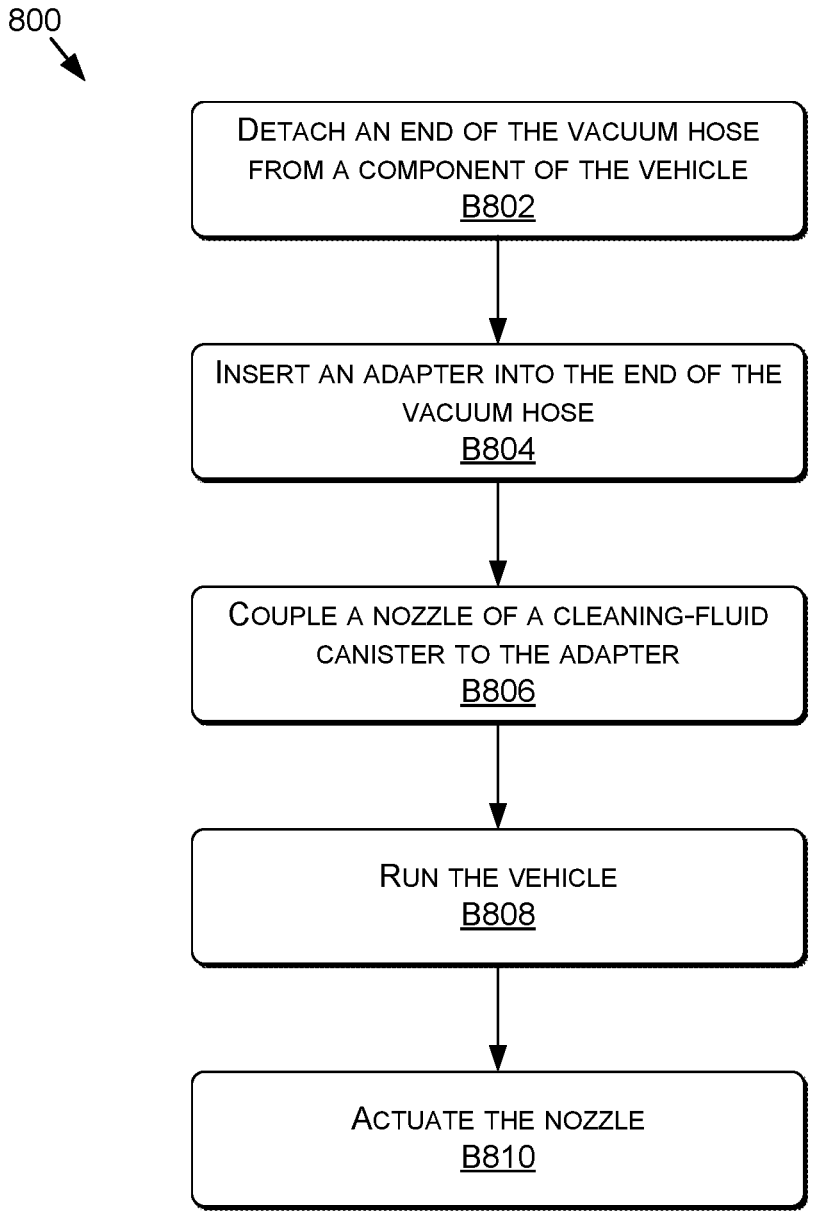
FIG. 8 illustrates a flow diagram including steps that may be performed when administering a cleaning fluid, in accordance with an embodiment of the present invention.

Various different aspects of an example vacuum-source adapter are described with respect to FIGS. 1-7. Referring now to FIG. 8, FIG. 8 depicts a flow diagram of steps that may be carried out when performing a method 800 of administering a cleaning fluid into a vacuum source of a vehicle engine. In describing the method 800, for exemplary and illustrative purposes, reference may be made to FIGS. 1-7 and the elements depicted therein and described above.

The method 800, at block 802, includes accessing a vacuum source, such as by detaching an end of a vacuum hose, or removing a sensor to open a sensor port, from a component of the vehicle.

The method 800, at block 804, includes inserting an adapter 110 into the vacuum source. For example, the vacuum-source insert 112 may be inserted into the end of the vacuum hose to frictionally engage the inner surface of the vacuum hose.

The method 800, at block 806, includes coupling a nozzle of a cleaning-fluid canister to the adapter. For example, a distribution member (e.g., extension tube or straw) extending from the nozzle may be inserted through, and frictionally engaged in, the second opening 118.

The method 800, at block 808, includes running the vehicle. For example, the vehicle may have been started prior to inserting the adapter, or after inserting the adapter, and allowed to continue running.

The method 800, at block 810, includes actuating the nozzle. For example, the canister nozzle may be manually depressed at one or more intervals while the vehicle is running.

The method 800 may be optimized and/or adjusted in various manners depending on the conditions under which the method 800 is performed. For example, the vehicle may be allowed to reach an operational state prior to inserting the adapter 110 and/or actuating the nozzle. In one aspect, the vehicle may be allowed to warm up for an amount of time or until the engine reaches an operating temperature between 65° Celsius (i.e., 149° Fahrenheit) to 105° Celsius (i.e., 221° Fahrenheit). In some instances, this may increase the likelihood that a negative pressure pulled through the vacuum source (and on the adapter in turn) is consistent and/or in a target range.

In other instances, the method may include revving the engine at one or more intervals while one or more canisters of cleaning fluid are administered. For example, the engine may be revved at intervals of about once every 15 seconds to about once every 25 seconds during the administration of cleaning fluid, and in one aspect the engine is revved every 20 seconds or 3 revs/minute. Among other things, revving may reduce the likelihood that cleaning fluid puddles and help to propel the cleaning fluid through the system and across the components to be cleaned. Propelling the cleaning fluid may cause agitation at the site of movement, contributing to removal of baked on deposits from the site (e.g., intake valve).

In further aspects, the method may include depressing the nozzle at intervals or cycles that include an "on" or "nozzle depressed" state and an "off" or "nozzle released" state. For example, in some instances, a cycle may be repeated including a 5-second nozzle-depressed state and a 1-second nozzle-released state (i.e., total cycle or interval is 6 seconds), in which case the cycle may be repeated 10 times in a minute. In other instances, a cycle may be repeated including a 1-second nozzle-depressed state and a 5-second nozzle-released state (i.e., total cycle or interval is 6 seconds), in which case the cycle may be repeated 10 times in a minute. The cadence of the cycle (e.g., "off" time compared to "on" time) may depend on the size of the engine. For example, engines with larger displacement may tolerate longer "on" intervals without stumbling, while servicing engines with smaller displacement may be smoother with shorter "on" intervals. Accordingly, an aspect of the present disclosure includes repeating a cycle of an "on" interval and an "off" interval. The cycle may be repeated a number of times per minute in a range from about 6 cycles to about 15 cycles. In addition, the total time of each cycle (i.e., one "on" interval and one "off" interval) may be in a range from about 4 seconds to about 10 seconds. Each of the "on" interval and the "off" interval may last a duration in a range from about 1 second to about 9 seconds.

Some aspects of this disclosure have been described with respect to the examples provided by FIGS. 1-8. Additional aspects of the disclosure will not be described that may be related subject matter included in one or more claims of this application, or one or more related applications, but the claims are not limited to only the subject matter described in the below portions of this description. These additional aspects may include features illustrated by FIGS. 1-8, features not illustrated by FIGS. 1-8, and any combination thereof. When describing these additional aspects, reference may be made to elements depicted by FIGS. 1-8 for non-limiting, illustrative purposes.

As such, one aspect of the present disclosure includes an adapter (e.g., 110) to attach to a vacuum source (e.g., to an end 13 of an engine vacuum hose 11). The adapter comprises a first terminal end (e.g., 122) with a first opening (e.g., 116) and a second terminal end (e.g., 148) with a second opening (e.g., 118). In addition, the adapter includes flow-metering circuitry (e.g., circuits 154, 156, and 162) fluidly coupled with the first opening and a fluid-collection chamber (e.g., 152) fluidly coupled with the flow-metering circuitry and with the second opening.

Another aspect of the present disclosure is directed to an adapter (e.g., 110) to attach to a vacuum source (e.g., to an end 13 of an engine vacuum hose 11). The adapter comprises a vacuum-source insert (e.g., 112) comprising a first opening (e.g., 116). In addition, the adapter includes a nozzle receiver 114 comprising second opening (e.g., 118) in fluid communication with the first opening. The adapter also includes flow-metering circuitry between the first opening and the second opening, and the flow-metering circuitry comprises a cleaning-fluid circuit (e.g., 154, 156, and 162) having a flow restrictor and an airflow circuit (e.g., 158 and 160) fluidly coupled with the cleaning-fluid circuit. The adapter further includes a fluid-collection chamber (e.g., 152) between the second opening and the flow-metering circuitry.

From the foregoing, it will be seen that this invention is one well adapted to attain all ends and objects hereinabove set forth together with the other advantages which are obvious and which are inherent to the method and apparatus. It will be understood that certain features and subcombinations are of utility and may be employed without reference to other features and subcombinations. This is contemplated by and is within the scope of the present invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

The invention claimed is:

1. An adapter to attach to an engine vacuum source, the adapter comprising:

a first terminal end with a first opening and a second terminal end with a second opening;

flow-metering circuitry fluidly coupled with the first opening and a fluid-collection chamber fluidly coupled with the flow-metering circuitry and with the second opening; and a flow dampener positioned in the fluid-collection chamber and between the second opening and the flow-metering circuitry.

2. The adapter of claim 1, wherein the second opening includes a perimeter edge circumscribing the second opening and a first width between opposing points on the perimeter edge; and wherein the fluid-collection chamber is enclosed by a wall of the adapter body having an inner surface facing the fluid-collection chamber and includes a second width between opposing points on the inner surface, the first width being smaller than the second width.

3. The adapter of claim 1, wherein the second opening includes a perimeter edge circumscribing the second opening, the perimeter edge to receive and frictionally engage a distribution member of a cleaning-fluid canister.

4. The adapter of claim 1 further comprising, a lid coupled to the adapter body, the lid comprising the second opening.

5. The adapter of claim 1, wherein the flow dampener comprises a plurality of bristles.

6. The adapter of claim 1, wherein the flow-metering circuitry includes a fluid circuit between the fluid-collection chamber and the first opening, and wherein a flow restrictor is positioned between the fluid-collection chamber and the fluid circuit.

7. The adapter of claim 1, wherein the flow-metering circuitry includes a cleaning-fluid circuit connecting the fluid-collection chamber to the first opening and through which cleaning fluid is flowable from the fluid-collection chamber to the first opening; and wherein the flow-metering circuitry includes one or more peripheral circuits that intersect the cleaning-fluid circuit.

8. The adapter of claim 1, wherein the adapter body comprises a vacuum-source insert that decreases in size from a wider portion closer to the fluid-collection chamber to a narrower portion closer to the first opening.

9. The adapter of claim 1, wherein the adapter body comprises a vacuum-source insert having one or more annular bodies.

10. A method of administering a cleaning fluid into a vacuum source of a vehicle engine, the method comprising:

accessing the vacuum source;

inserting an adapter into the vacuum source;

coupling a nozzle of a cleaning-fluid canister to the adapter;

running the vehicle; and actuating the nozzle by manually depressing the nozzle in intervals, wherein:

each interval of the intervals comprises a total interval time in a range of about 4 seconds to about 10 seconds, and each interval includes depressing the nozzle for a first time duration in a range of about 1 second to about 9 seconds and releasing the nozzle for a second time duration in a range of about 1 second to about 9 seconds.

11. The method of claim 10, wherein coupling the nozzle to the adapter comprises frictionally fitting a distribution member into an opening of the adapter.

12. The method of claim 10 further comprising, revving the vehicle at one or more intervals.

13. The method of claim 12, wherein the intervals comprise about two to about four rev cycles every minute.

14. An adapter to attach to an engine vacuum source, the adapter comprising:

a vacuum-source insert comprising a first opening;

a nozzle receiver comprising a second opening in fluid communication with the first opening;

flow-metering circuitry between the first opening and the second opening, the flow-metering circuitry comprising a cleaning-fluid circuit having a flow restrictor and an airflow circuit fluidly coupled with the cleaning-fluid circuit; and a fluid-collection chamber between the second opening and the flow-metering circuitry.

15. The adapter of claim 14, wherein the airflow circuitry fluidly couples with the cleaning-fluid circuit at an intersection between the flow restrictor and the first opening.

16. The adapter of claim 14 further comprising, a bristled flow moderator positioned in the fluid-collection chamber.

17. The adapter of claim 14, wherein the nozzle receiver comprises a wall that at least partially encloses the fluid-collection chamber and that comprises the second opening having a perimeter edge, the perimeter edge to receive and frictionally engage a nozzle extension tube or straw.

* * * * *